US007219394B2

(12) United States Patent
Wu

(10) Patent No.: US 7,219,394 B2
(45) Date of Patent: May 22, 2007

(54) DOOR PUSH BAR STRUCTURE

(76) Inventor: Pauli Wu, 4F., No.837, Pei An Rd., Taipei (TW)

( * ) Notice: Subject to any disclaimer, the term of this patent is extended or adjusted under 35 U.S.C. 154(b) by 152 days.

(21) Appl. No.: 11/023,134

(22) Filed: Dec. 27, 2004

(65) Prior Publication Data

US 2006/0137143 A1 Jun. 29, 2006

(51) Int. Cl.
*E05B 1/00* (2006.01)

(52) U.S. Cl. ..... 16/412

(58) Field of Classification Search ..... 16/412, 16/414, 443, 444, DIG. 40, DIG. 41; 292/348, 292/350, 357–359, 336.3, DIG. 53, DIG. 63; 4/596, 599, 600, 610, 670; 49/460, 461
See application file for complete search history.

(56) References Cited

U.S. PATENT DOCUMENTS

| | | | | | |
|---|---|---|---|---|---|
| 2,059,319 | A | * | 11/1936 | De Vries | 292/352 |
| 2,576,511 | A | * | 11/1951 | Jewett | 16/402 |
| 3,216,757 | A | * | 11/1965 | Campbell | 292/358 |
| 4,788,745 | A | * | 12/1988 | Wallis et al. | 16/413 |
| 4,912,809 | A | * | 4/1990 | Scheuer | 16/413 |
| 6,463,628 | B1 | * | 10/2002 | Yeh | 16/412 |
| 6,966,101 | B2 | * | 11/2005 | Chiang | 16/412 |

FOREIGN PATENT DOCUMENTS

| | | | | |
|---|---|---|---|---|
| DE | 1901798 | B | * | 4/1975 |
| DE | 2415905 | A | * | 10/1975 |
| DE | 2435359 | A | * | 2/1976 |
| EP | 156793 | A | * | 10/1985 |
| JP | 09177383 | A | * | 7/1997 |
| JP | 10082216 | A | * | 3/1998 |
| JP | 10231649 | A | * | 9/1998 |

* cited by examiner

*Primary Examiner*—Chuck Y. Mah
(74) *Attorney, Agent, or Firm*—Birch, Stewart, Kolasch & Birch, LLP

(57) ABSTRACT

A door push bar structure includes a mounting mechanism having a locking element with a stopper, a sleeve screwed at an end to the locking element, and a locating element, the stopper and an end of the locking element screwed to the sleeve being located in a through hole on a door, and the opposite end of the sleeve being pressed against an outer side of the through hole of the door; and two door push bars, one of which is provided at each end surface with a hole for fixedly connecting with an opposite end of the locking element, and the other one is provided at each end surface with a horizontal hole for receiving the opposite end of the sleeve therein, and a vertical hole communicating with the horizontal hole for the locating element to extend thereinto to firmly press against the opposite end of the sleeve.

5 Claims, 5 Drawing Sheets

DOOR PUSH BAR STRUCTURE

FIELD OF THE INVENTION

The present invention relates to a door push bar structure, and more particularly to a door push bar structure that could be firmly mounted on a door.

BACKGROUND OF THE INVENTION

FIG. 1 shows a conventional door push bar structure that is mounted on a door 5 by extending a mounting bolt 4 through a predetermined position on the door 5, so that an expanded head portion 41 of the mounting bolt 4 is pressed against an outer side of the door 5; and connecting two push bars 51, 52 to two opposite ends of the mounting bolt 4. The push bar 51 that is connected to the expanded head portion 41 of the mounting bolt 4 is provided with a stop element 53, so that the push bars 51, 52 are attached to the door 5 at desired positions. A user may then apply a force on the push bar 51 or 52 to open or close the door 5.

However, since the push bars 51, 52 are installed on the door 5 simply by screwing the mounting bolt 4 through the door 5 into an end of the other push bar 52, frequent pull or push of the push bars 51, 52 would cause loosening of the push bars 51, 52, particularly the push bar 52, from the door 5 to result in unstable connection of the push bars 51, 52 to the door 5. Moreover, there doors 5 with different thickness. For a thicker door 5, a longer mounting bolt 4 is needed to secure firm connection of the push bar 52 to the door 5. Reversely, for a thinner door 5, a shorter mounting bolt 4 is sufficient for use. Therefore, many differently sized mounting bolts 4 have to be prepared for mounting the push bars 51, 52 on doors 5 with different thickness. This would inevitably result in increased material cost for the mounting bolts 4 as well as inconveniences and confusions to the workers mounting the push bars.

SUMMARY OF THE INVENTION

A primary object of the present invention is to provide a door push bar structure that could be firmly installed on a door with a mounting mechanism.

To achieve the above and other objects, the door push bar structure according to the present invention includes a mounting mechanism having a locking element with a stopper, a sleeve screwed at an end to an end of the locking element, and a locating element pressed against an opposite end of the sleeve, the stopper and the end of the locking element screwed to the sleeve being located in a through hole on a door, and the opposite end of the sleeve being pressed against an outer side of the through hole of the door; and a pair of door push bars consisting of a first and a second push bar, the first push bar being provided at each end surface with a hole for fixedly connecting with an opposite end of the locking element, and the second push bar being provided at each end surface with a horizontal hole for receiving the opposite end of the sleeve therein, and a vertical hole communicating with the horizontal hole for the locating element to extend thereinto to firmly press against the opposite end of the sleeve.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
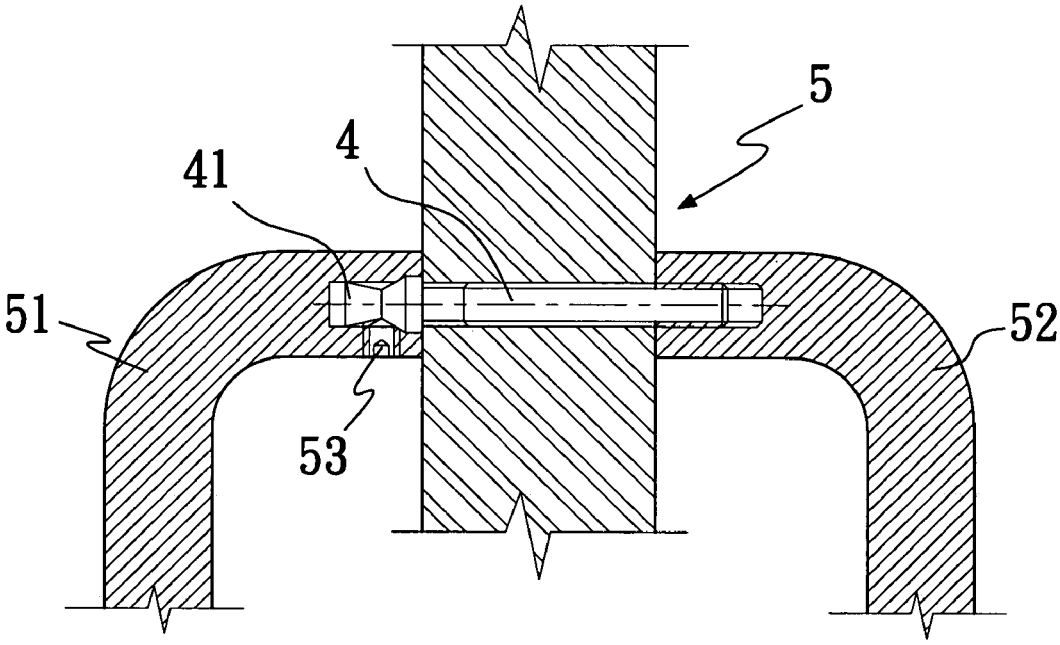
(PRIOR ART) Fig. 1
FIG. 1 is a sectional view schematically shows the installation of a conventional door push bar structure on a door.
Figure 2:
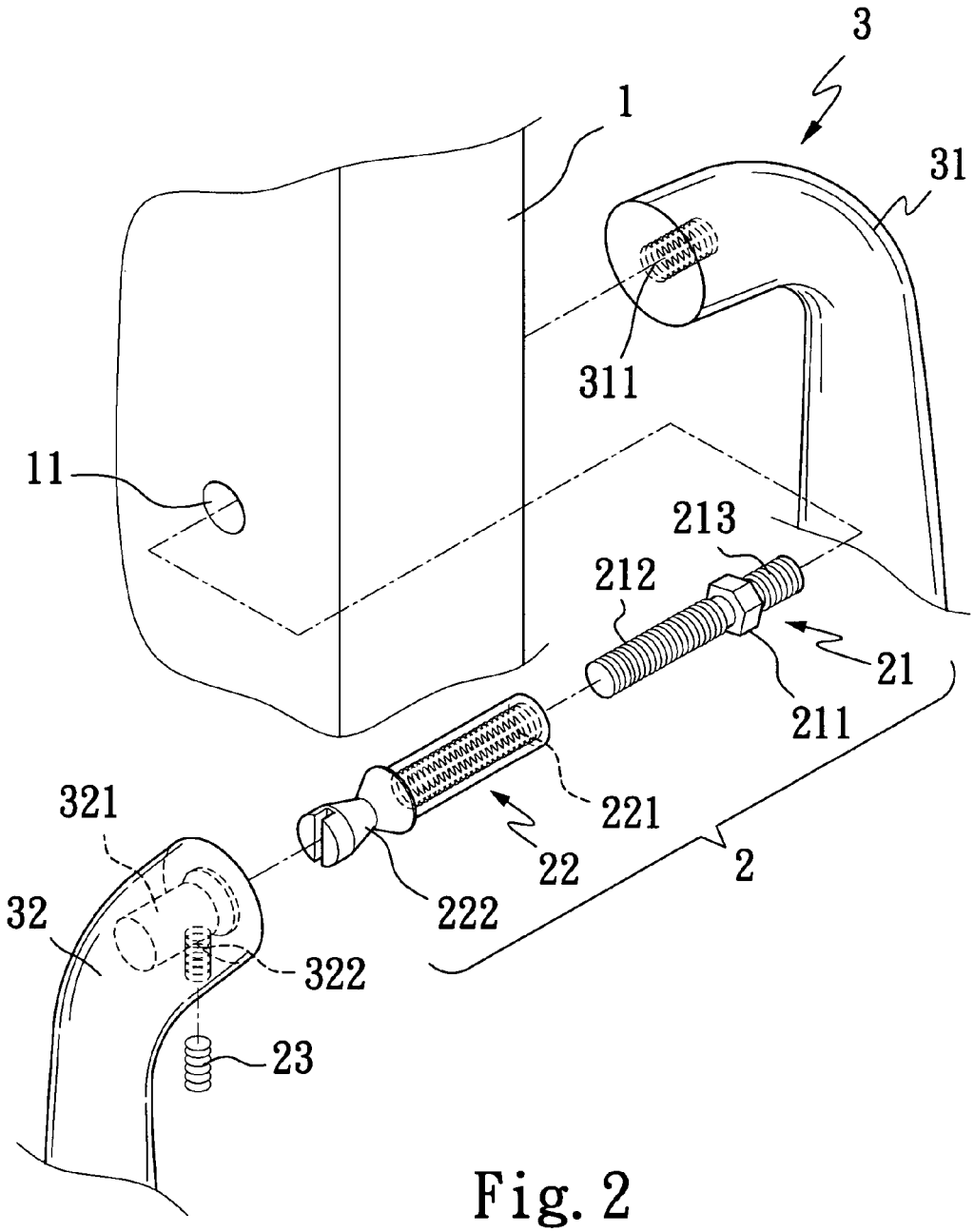
FIG. 2 is a fragmentary, exploded perspective view of a door push bar structure according to the present invention.

Please refer to FIG. 2 that is a fragmentary, exploded perspective view of a door push bar structure according to the present invention for mounting on a door 1. As shown, the door push bar structure of the present invention includes a mounting mechanism 2 and a pair of push bars 3 firmly installed on the door 1 via the mounting mechanism 2.

The mounting mechanism 2 is located in a through hole 11 provided on the door 1, and includes a locking element 21, a sleeve 22, and a locating element 23. The locking element 21 includes a stopper 211, a first externally threaded section 212 located at one side of the stopper 211, and a second externally threaded section 213 located at the other side of the stopper 211 opposite to the first threaded section 212. The sleeve 22 includes an axially extended and internally threaded bore 221 adapted to screw to the first threaded section 212 of the locking element 21. An end of the sleeve 22 opposite to an open end of the threaded bore 221 forms a tightening head 222 having an outer diameter larger than a diameter of the through hole 11 on the door 1. The locating element 23 is perpendicularly pressed against one side of the tightening head 222 of the sleeve 22, so that the first threaded section 212 and the stopper 211 of the locking element 21 and the threaded bore 221 of the sleeve 22 are held in the through hole 11 of the door 1 with the tightening head 222 of the sleeve 22 pressed against an outer side of the through hole 11.

The pair of push bars 3 includes a first and a second push bar 31, 32 oppositely installed at two sides of the door 1. The first push bar 31 is provided at each end with an internally threaded hole 311 adapted to screw to the second threaded section 213 of the locking element 21. The second push bar 32 is provided at each end with a horizontal hole 321 adapted to receive the tightening head 222 of the sleeve 22 therein. A vertical hole 322 is further provided on the second push bar 32 to communicate with each horizontal hole 321. The locating element 23 is upward extended into the vertical hole 322 to press against the tightening head 222 of the sleeve 22.

Figure 3:
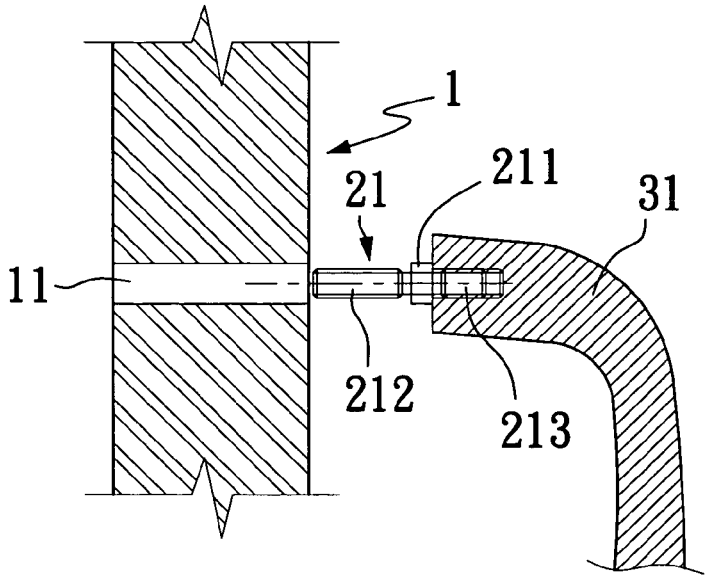
FIGS. 3 to 7 are fragmentary, sectional views schematically show the installation of the door push bar structure of the present invention on a door having a first thickness.
Figure 4:
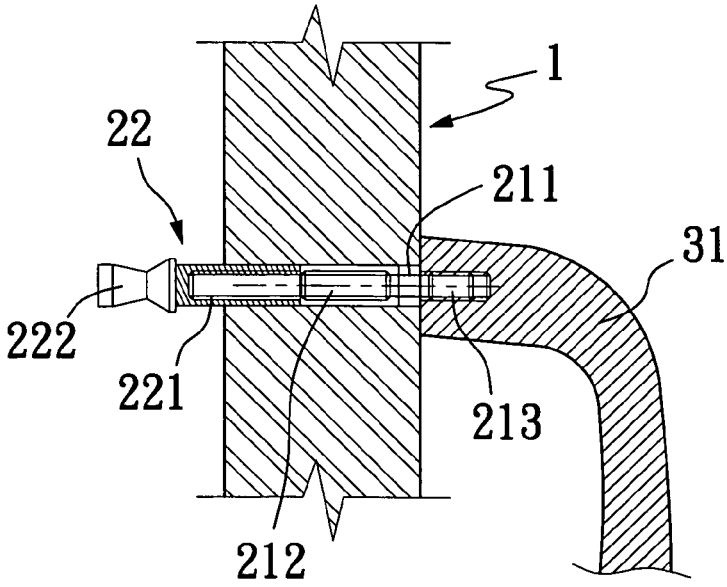
Figure 5:
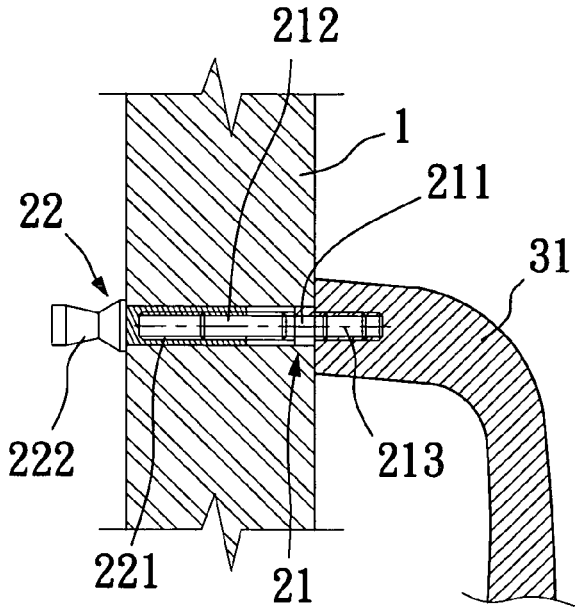
Figure 6:
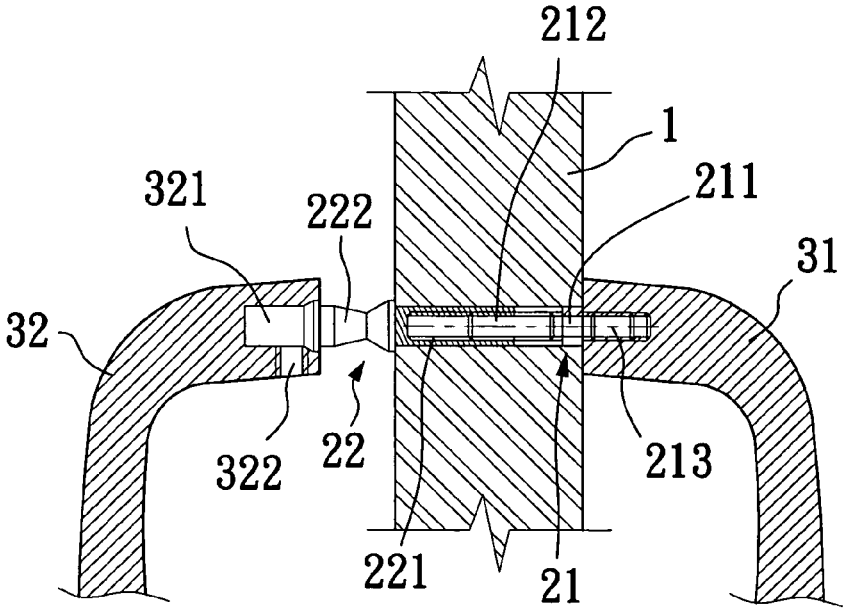
Figure 7:
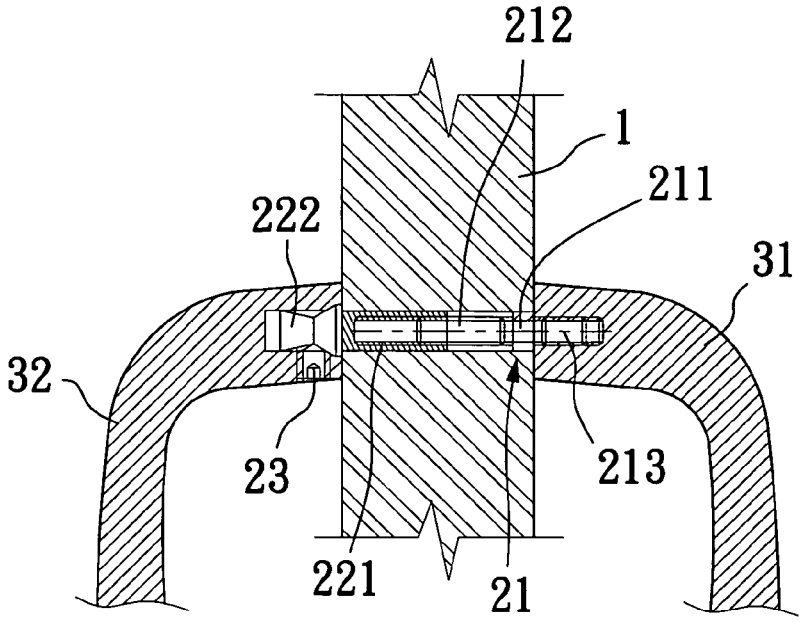

FIGS. 3 to 7 illustrates the manner of installing the door push bar structure of the present invention on the door 1. Since the two push bars 31, 32 are connected at respective upper and lower ends to the door 1 via two sets of the mounting mechanism 2 in the same manner, only the connection of the upper ends of these two push bars 31, 32 to the door 1 is described herein. To mount the door push bar structure of the present invention on the door 1, first screw the second threaded section 213 of the locking element 21 of the mounting mechanism 2 into the internally threaded hole 311 on the upper end of the first push bar 31 until the stopper 211 of the locking element 21 is firmly pressed against an outer side of the threaded hole 311, as shown in FIG. 3. As can be seen from the drawings, the stopper 211 has an outer diameter smaller than the through hole 11 and larger than the internally threaded hole 311, and can therefore be located in the through hole 11. Then, extend the first threaded section 212 of the locking element 21 into the through hole 11 via one side of the door 1, and extend the end of the sleeve 22 with the threaded bore 221 into the through hole 11 via the other side of the door 1 to engage the threaded bore 221 of the sleeve 22 with the first threaded section 212 of the locking element 21 until the diametrically larger tightening head 222 of the sleeve 22 is pressed against an outer side of the through hole 11, as shown in FIGS. 4 and 5. Thereafter, align and connect the horizontal hole 321 on the second push bar 32 with the tightening head 222 of the sleeve 22, and screw the locating element 23 into the horizontal hole 321 via the vertical hole 322 to press against the tightening head 222 of the sleeve 22 received in the horizontal hole 321, as shown in FIGS. 6 and 7. By doing so, the pair of push bars 3 is firmly connected to the door 1 via the mounting mechanism 2.

Figure 8:
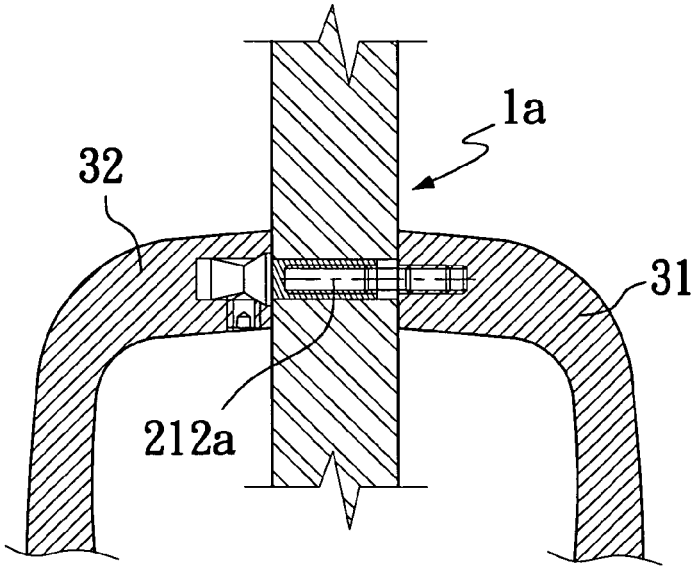
FIG. 8 shows the installation of the present invention on a different door having a second thickness.

It is noted the mounting mechanism 2 may be used with doors of different materials and thickness. FIG. 8 shows the door push bar structure of the present invention is installed on a door 1*a* having a thickness smaller than that of the door 1 shown in FIG. 3 to 7. To mount the door push bar structure 3 on a thinner door 1*a*, a user needs only to adjust a travel by which the internally threaded bore 221 of the sleeve 22 is screwed to the first threaded section 212 of the locking element 21. That is, the screwing travel is shorter for the door 1 that has a larger thickness, and longer for the door 1*a* that has a smaller thickness.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A door push bar structure, comprising:

a mounting mechanism on which said door push bar structure is installed; said mounting mechanism including a locking element having a stopper, a sleeve and a locating element, the sleeve having a first and second end, the first end of the sleeve being screwed at an end to an end of said locking element, and the locating element being pressed against the second end of said sleeve; said stopper and said end of said Locking element screwed with said sleeve being located in a through hole of a door, and the second end of said sleeve being pressable against an outer side of said door; and a pair of door push bars having a first bar and a second push bar, said first push bar having an end surface provided with a hole for fixedly connecting with said locking element; and said second push bar having an end surface with a horizontal hole for receiving the second end of said sleeve therein, and the second push bar having a vertical hole communicating with said horizontal hole for said locating element to extend thereinto to firmly press against said second end of said sleeve.

2. The door push bar structure as claimed in claim 1, wherein said locking element includes a first externally threaded section located at the screwed end at one side of said stopper, and a second externally threaded section located at an opposite side of said stopper.

3. The door push bar structure as claimed in claim 1, wherein said first end of said sleeve screwed to said locking element is formed with an internally threaded bore.

4. The door push bar structure as claimed in claim 1, wherein said second end of said sleeve is formed into a tightening head having an outer diameter larger than said through hole.

5. The door push bar structure as claimed in claim 1, wherein said hole on the end surface of said first push bar is internally threaded.

* * * * *